US008756737B2

(12) United States Patent
Chan

(10) Patent No.: US 8,756,737 B2
(45) Date of Patent: Jun. 24, 2014

(54) AIR TOOL WITH MODULARIZED AIR PAD

(75) Inventor: Jui-Peng Chan, Changhua (TW)

(73) Assignees: Trinity Biotech Co., Ltd., Changhua (TW); Cheng-Yang Chan, Changhua (TW); Yu-Hun Chan, Changhua (TW)

( * ) Notice: Subject to any disclaimer, the term of this patent is extended or adjusted under 35 U.S.C. 154(b) by 370 days.

(21) Appl. No.: 13/272,659

(22) Filed: Oct. 13, 2011

(65) Prior Publication Data

US 2012/0096648 A1 Apr. 26, 2012

(30) Foreign Application Priority Data

Oct. 25, 2010 (TW) ..... 099220549 U

(51) Int. Cl.
*A47C 27/10* (2006.01)
*A47C 27/00* (2006.01)

(52) U.S. Cl.
CPC ..... *A47C 27/001* (2013.01); *A47C 27/10* (2013.01)
USPC ..... 5/715; 5/710; 5/713

(58) Field of Classification Search
CPC ..... A47C 27/001; A47C 27/10; A47C 20/048
USPC ..... 5/613–615, 617, 618, 634, 710, 713, 5/715, 722, 654, 655.3, 655.9, 657, 942, 5/691
See application file for complete search history.

(56) References Cited

U.S. PATENT DOCUMENTS 4,947,500 A * 8/1990 Seiler ..... 5/713
5,794,289 A * 8/1998 Wortman et al. ..... 5/713
6,922,863 B2 * 8/2005 Giori et al. ..... 5/709

* cited by examiner

*Primary Examiner* — Nicholas Polito
(74) *Attorney, Agent, or Firm* — Wang Law Firm, Inc.; Li K. Wang; Stephen Hsu

(57) ABSTRACT

An air tool with a modularized air pad includes several air pad units, each of which has one pad body whose top surface is formed with an accommodating recess and whose one side has an air opening; two air bags disposed at the bottom of the accommodating recess, each of the air bags having two air chambers and connecting to the air opening via an air pipe; and one buffer pad accommodated in the accommodating recess on the air bags. When the air opening is selected to inflate the air chamber of one air bag, the buffer pad undergoes an upward swing motion according to the inflated air bags.

8 Claims, 8 Drawing Sheets

AIR TOOL WITH MODULARIZED AIR PAD

BACKGROUND OF THE INVENTION

1. Field of Invention

The invention relates to an airbed and, in particular, to an air tool with a modularized air pad.

2. Related Art

Most seriously ill or injured people lying on beds cannot turn their bodies by themselves. One result is bad blood circulation in the portion under pressure. Another result is that as the patient maintains the same lying gesture for a long time in an environment without good ventilation, it is possible to induce bedsore, skin ulcer, etc. Therefore, there are airbeds on the market to help patients turn their bodies by inflation.

FIG. 7 shows a conventional airbed with the function of helping patients turn their bodies. The main structure is one inflatable pipe 31, 32 on each side of the patient lying thereon. When one of the inflatable pipes 31, 32 is inflated, the corresponding inflatable pipe 31, 32 directly pushes the human body to turn. However, the user is not only likely to feel discomfort in this scheme because he/she is pushed or hit by the inflatable pipes 31, 32, there is also the danger of causing another injure to the patient if the instantaneous push or hit of the inflatable pipes 31, 32 is too large or the inflation/deflation speed is too quick.

FIG. 8 shows another conventional airbed with the function of helping patients turn their bodies. Its pad mainly consists of several inflatable pipes 41 disposed in parallel. Both sides of the bottom surface of the pad have at least two air bag pipes 42. The inflatable pipes 41 and the air bag pipes 42 are disposed in the longitudinal and transverse directions, respectively. However, as the inflatable pipes 41 and the air bag pipes 42 have the shape of a long cylinder, the pad surface formed by such a structure is not flat. The user may easily feel uncomfortable lying thereon. Moreover, as the inflatable pipes 41 and the air bag pipes 42 have the shape of a long cylinder, the deformation of the inflatable pipes 41 and the air bag pipes 42 may be too quick during inflation/deflation, also causing discomfort for the user.

SUMMARY OF THE INVENTION

One objective of the invention is to provide an air tool with a modularized air pad to help the patient thereon turn and prevent bedsore or skin ulcer.

Another objective of the invention is to provide an air tool with a modularized air pad to turn a human body in a more smooth and complete way.

To achieve the above-mentioned objectives, the disclosed air tool with a modularized air pad comprises a plurality of air pad units. Each of the air pad units has one pad body, two air bags, and one buffer pad.

The pad body has a top surface and a bottom surface. The top surface is formed with an accommodating recess. An air opening is formed at a predetermined position on the outer side of the pad body.

The two air bags are disposed at the bottom of the accommodating recess. Each of the air bags has two air chambers. The two air bags are connected with an air pipe, respectively. The air pipes of the two air bags are connected to the air opening of the pad body through the interior of the pad body.

The buffer pad is accommodated in the accommodating recess and on the air bag at the upper position. When the air chambers of the two air bags are selectively inflated via the air opening, the buffer pad undergoes an upward swing motion under the push of the air chambers of the two air bags.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
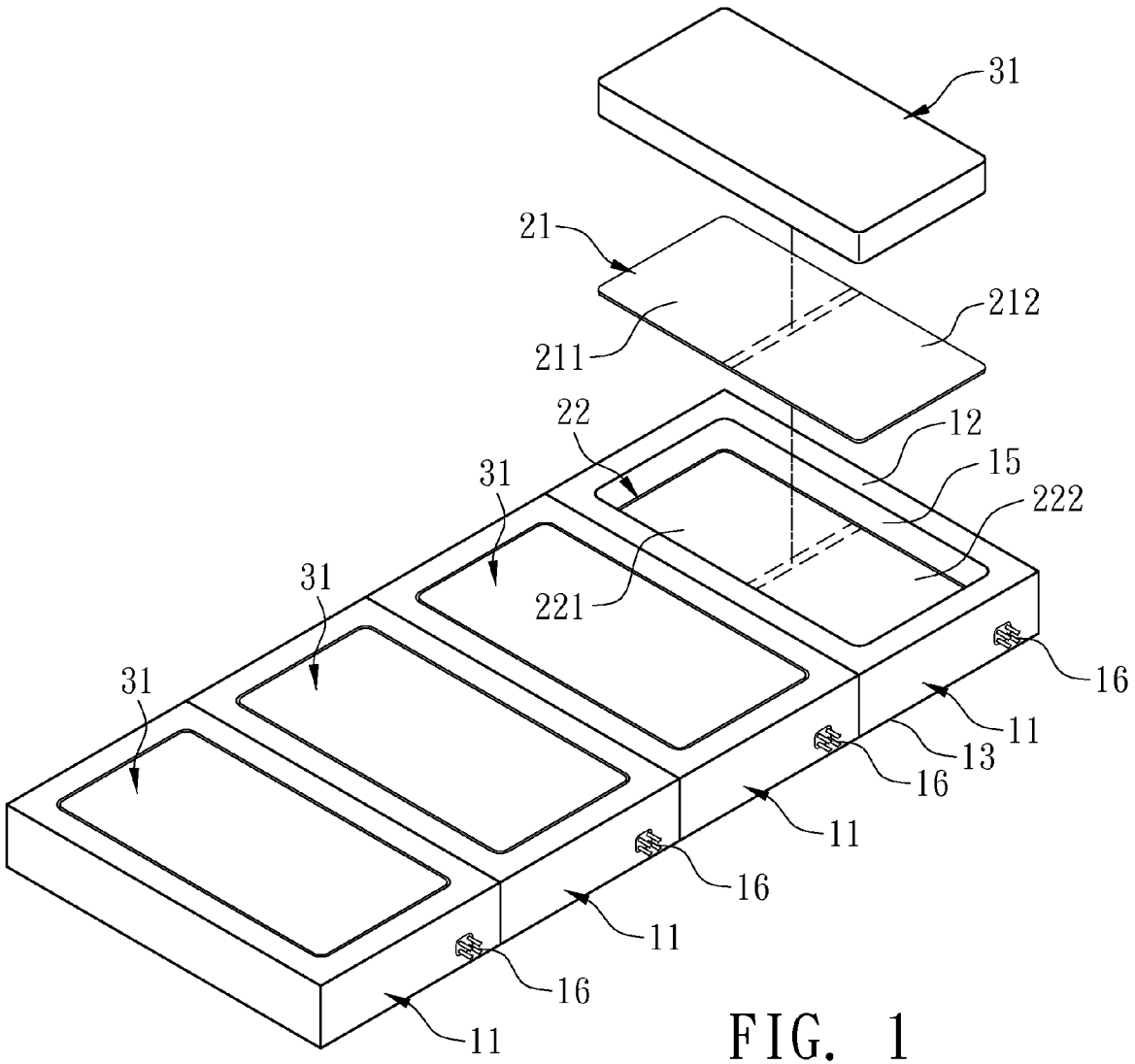
FIG. 1 is a three-dimensional exploded view of the first embodiment of the invention.
Figure 2:
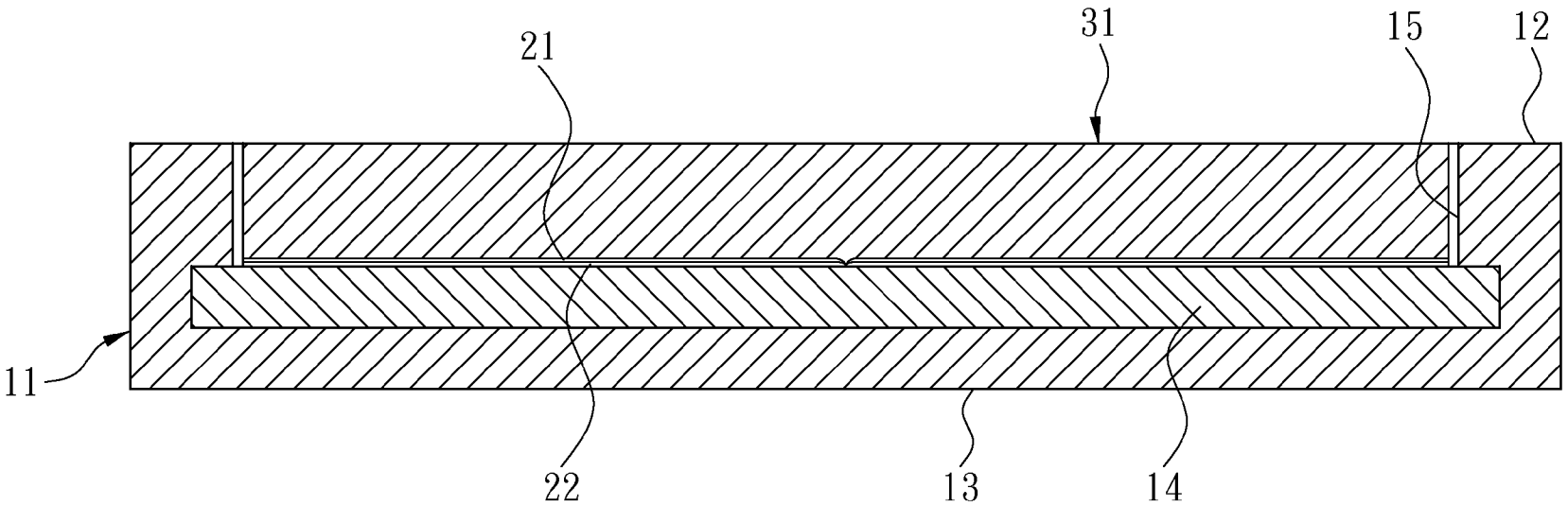
FIG. 2 is a cross-sectional view of the first embodiment of the invention.

Please refer to FIGS. 1 and 2 for a first embodiment of the air tool with a modularized air pad according to the invention. The air tool is a pad formed by several air pad units. Each of the air pad units includes one pad body 11, two air bags 21, and one buffer pad 31.

The pad body 11 is made of a foam material, and has a top surface 12 and a bottom surface 13. The inside of the pad body 11 has an intermediate layer 14. During the formation of the pad body 11, the central portion of the top surface 12 is formed with an accommodating recess 15 with an upward opening and in communications with the intermediate layer 14. An air opening 16 is formed at a predetermined position on the outer side of the pad body 11.

The two air bags 21, 22 have flat bag shapes and are stacked vertically at the bottom of the accommodating recess 15. The middle section of the two stacked air bags 21, 22 is connected to the intermediate layer 14. Inside of each of the air bags 21, 22 are two air chambers 211, 212, 221, 222. The two air bags 21, 22 are connected with an air pipe (not shown), respectively. The other end of the air pipe connected to the two air bags 21, 22 is connected to the air opening 16 of the pad body 11 via the intermediate layer 14. To facilitate assembly, the air opening 16 is a quick connector. The buffer pad 31 is also made of a foam material and disposed in the accommodating recess 15 of the pad body 11, pressing on the two air chambers 211, 212 of the upper air bag 21. The buffer pad 31 and the two opposite sides of the two air bags 21, 22 are pushed by the two air bags 21, 22 to undergo an upward swing motion.

In practice, a pump (not shown) outside is sued to inflate or deflate the air chambers 211, 212, 221, 222 of the two air bags 21, 22 via the air opening 16 of the pad body 11. When the operator selectively inflate the air chambers 211, 212, 221, 222 on one side of the two air bags 21, 22 via the air opening 16, the buffer pad 31 is pushed by the air chambers on the same side (e.g., 211, 221 or 212, 222) of the two air bags 21, 22 to turn from outside toward inside.

Figure 3:
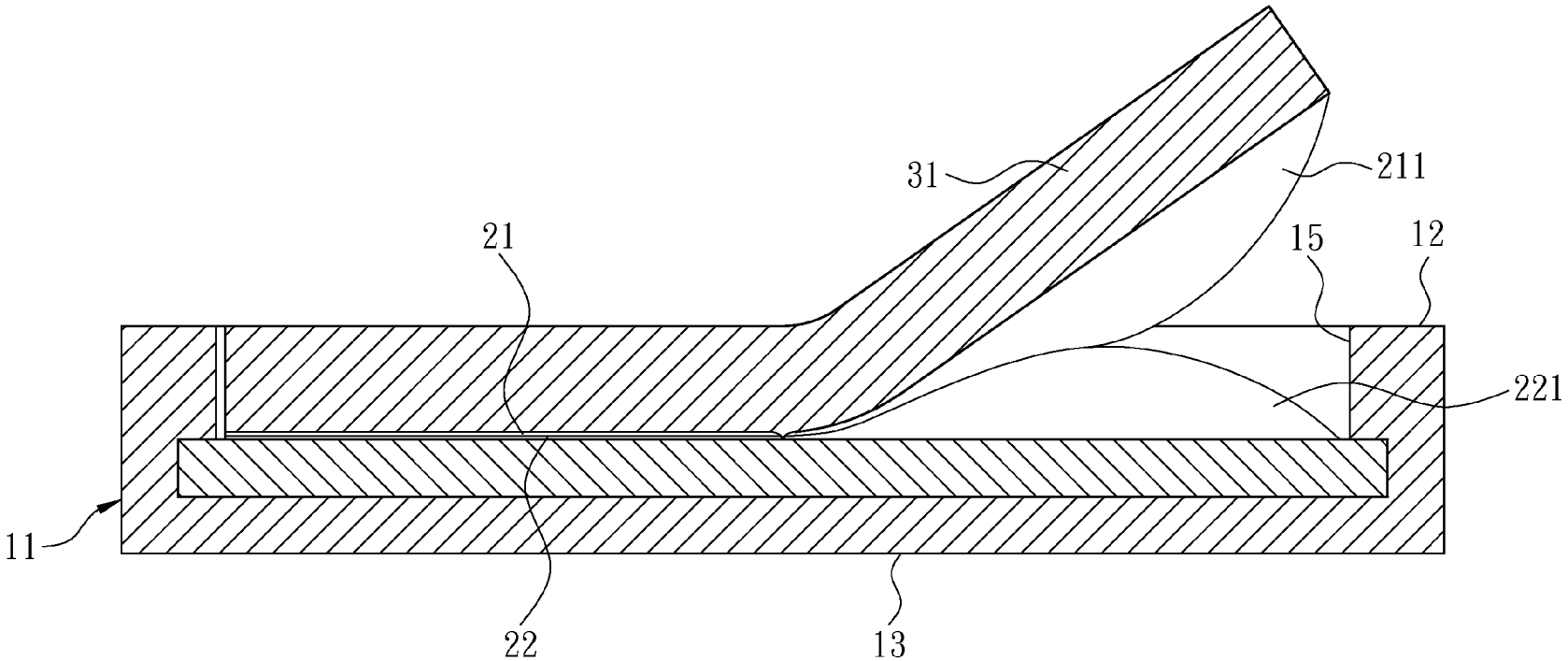
FIG. 3 shows one action of the first embodiment of the invention.

The air tool with a modularized pad according to the invention allows the setting of different action conditions according to user's practical needs. As shown in FIG. 3, when the air chambers 211, 221 on the same side of the two air bags 21, 22 are inflated, the buffer pad 31 gradually swings upward due to the inflation of the air chambers 211, 221. The human body lying on the pad body 11 is thus pushed up and turned by the buffer pad 31. Using flat bag-shaped air bags 21, 22 to push the buffer pad 31, the invention provides superior support before and after inflating the two air bags 21, 22. This greatly improves the comfort of the patient lying thereon.

Furthermore, the structure of the air bags 21, 22 stacked vertically and the buffer pad makes the human body turning process smoother. The disclosed air tool thus does not cause further injure to the patient lying thereon.

Of course, according to different needs, the two air bags 21, 22 can be simultaneously inflated. In this case, the buffer pad 31 is squeezed by the two air bags 21, 22 to have a V shape. This has some massage effect to make the lying patient have better blood circulation, thereby relaxing the patient's feeling and muscles. This can effectively improve sleep quality and help the user fall asleep quickly.

Figure 4:
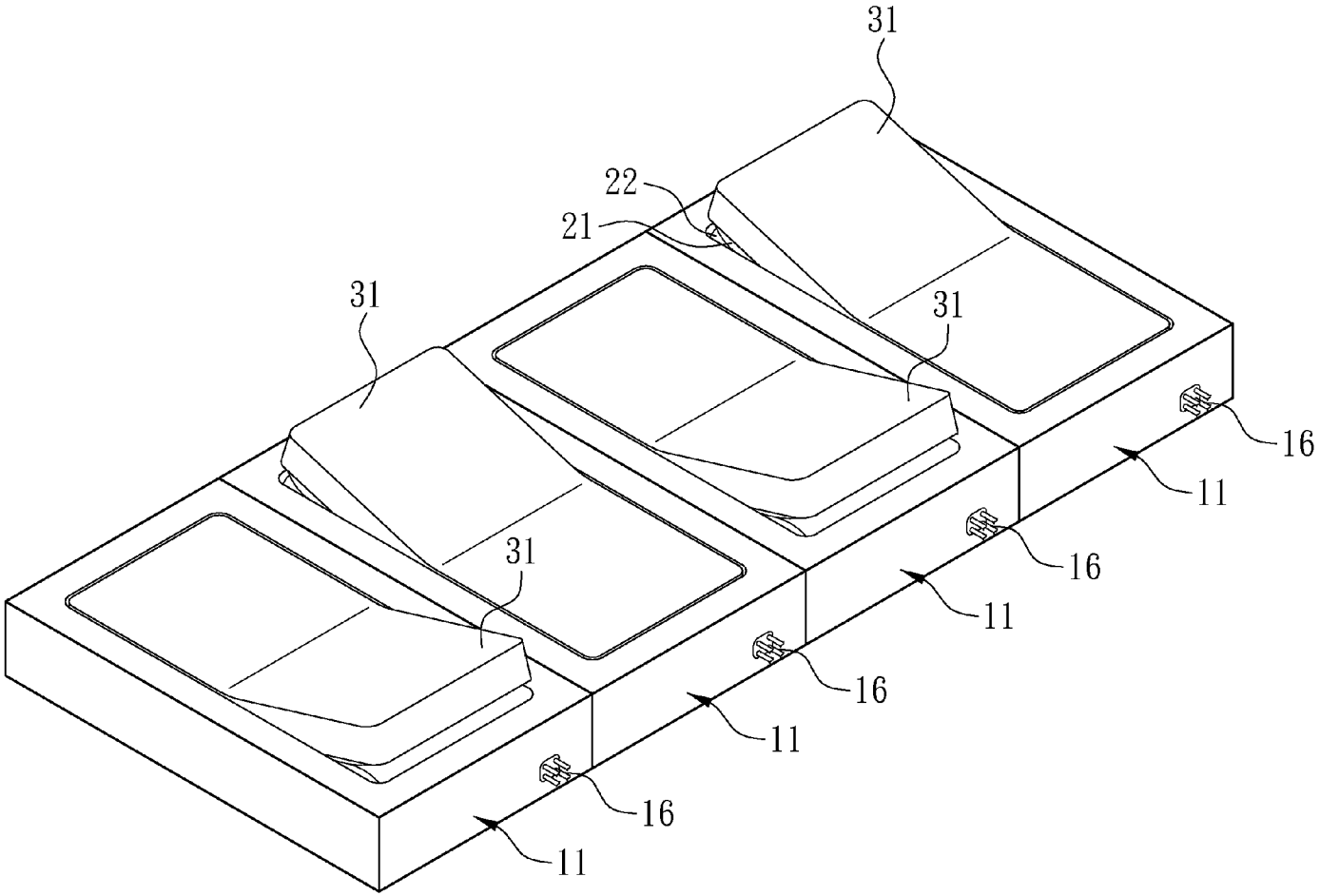
FIG. 4 shows another action of the first embodiment of the invention.

As shown in FIG. 4, the invention has several air bag units disposed together to form a bed. Therefore, the buffer pads 31 in the air pad units are pushed by the air bags 21, 22 to bulge in different directions. As the patient lying on the bed is pushed by the buffer pads 31 to, his/her gesture is bent or locally arched to stretch the body or to have ventilation between the patient and the mattress, preventing bedsore and skin ulcer from happening.

Figure 5:
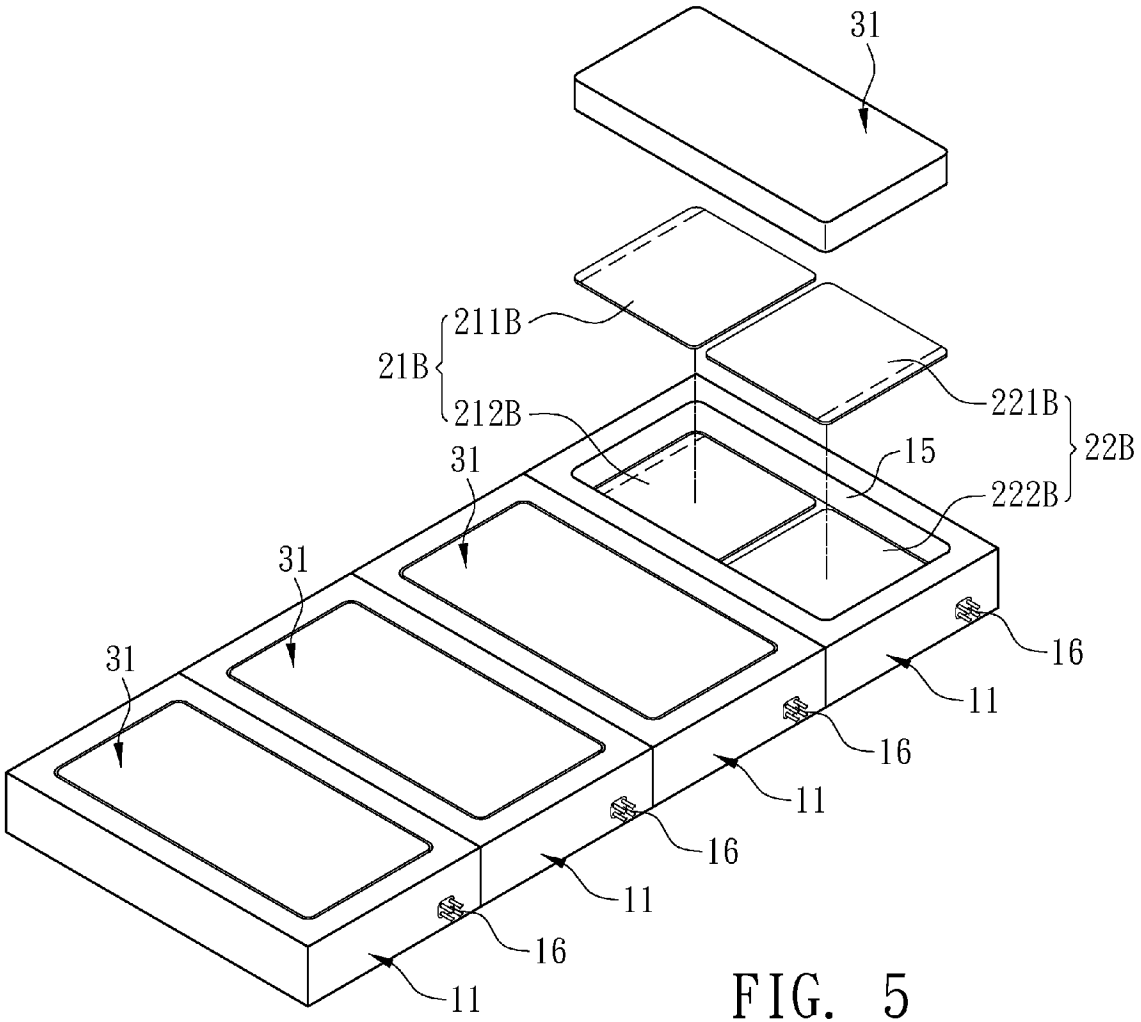
FIG. 5 is a structural view of the second embodiment of the invention.

Please refer to FIG. 5 for a second embodiment of the invention. This embodiment differs from the previous one in that the two air bags 21B, 22B are disposed side by side at the bottom of the accommodating recess 15. The two air bags 21B, 22B are connected to the intermediate layer 14 by the farther left and right sides. Each of the air bags 21B, 22B is respectively comprised of two air chambers 211B, 212B, 221B, 222B stacked vertically.

When an operator selectively inflate one of the air bags 21B, 22B via the air opening 16, the buffer pad 31 is pushed by the air chambers (211B, 212B or 221B, 222B) of the corresponding air bag 21B, 22B to undergo an outward swing, achieving the same effects as the previous embodiment. Furthermore, the air pad units of the first embodiment and the air pad units of the second embodiment can be combined to render a collective modularized air tool that have motions in different directions.

Figure 6:
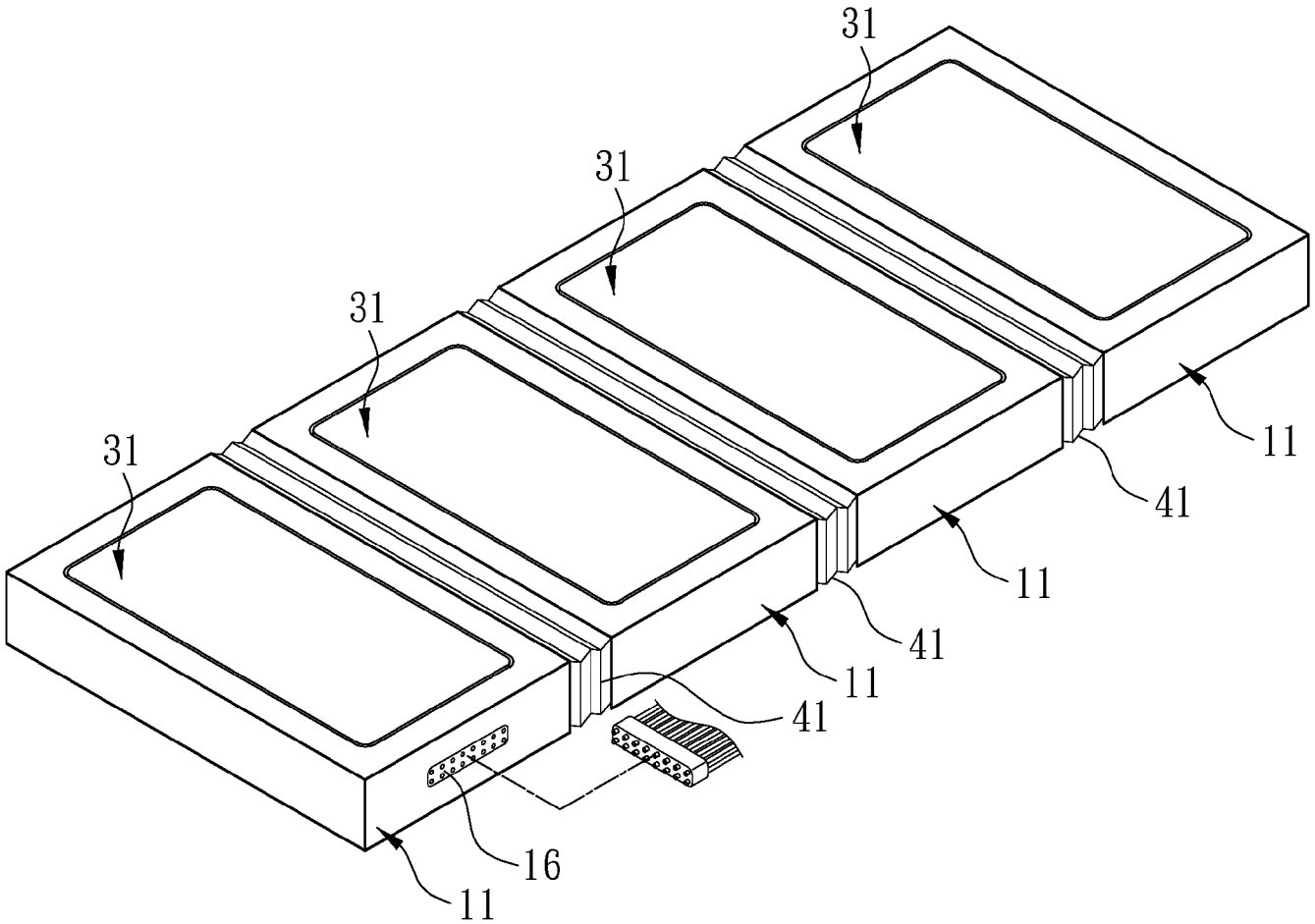
FIG. 6 is a structural view of the third embodiment of the invention.
Figure 7:
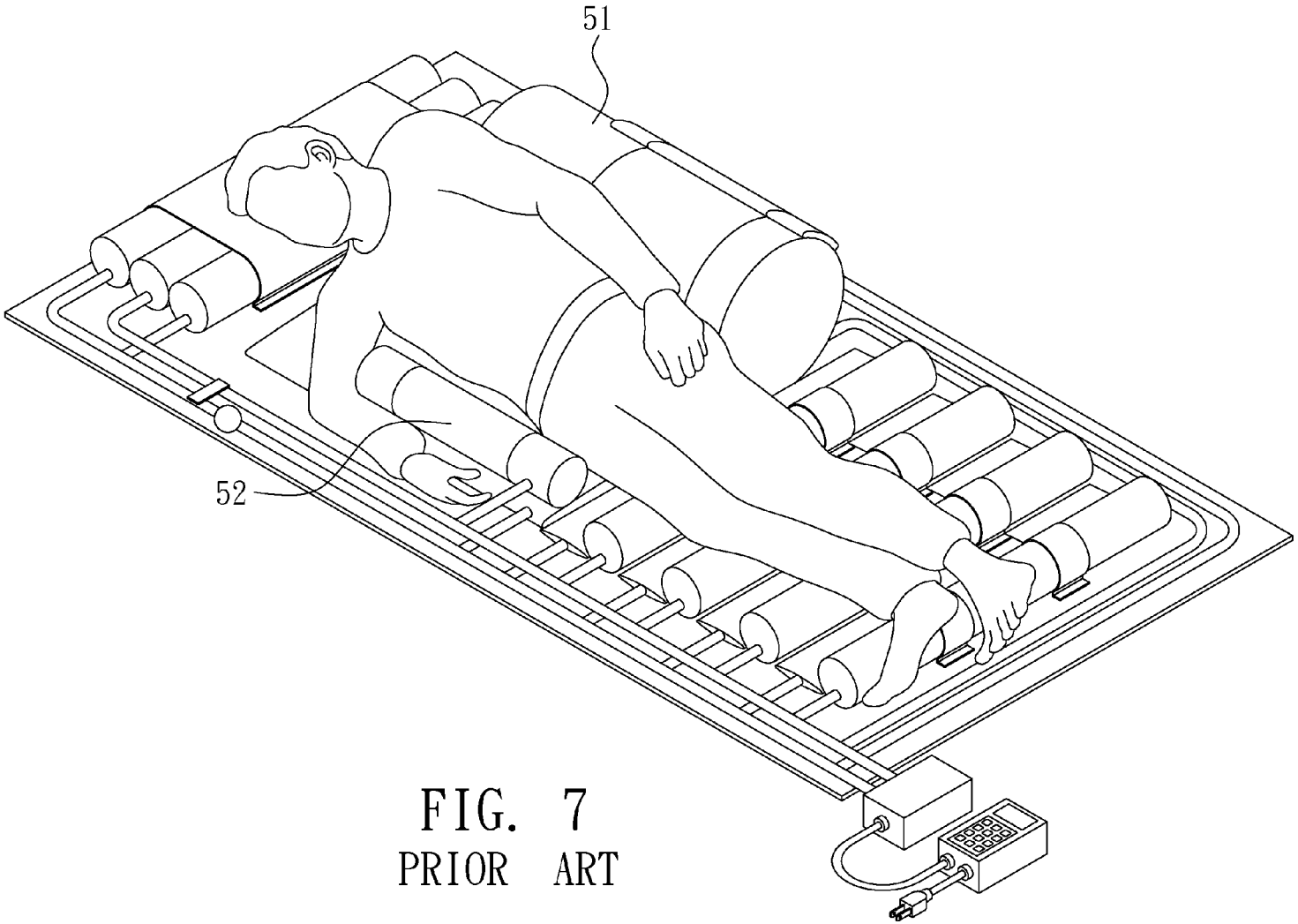
FIG. 7 PRIOR ART
FIG. 7 is a structural view of a conventional airbed with the function of helping turn the patient thereon.
Figure 8:
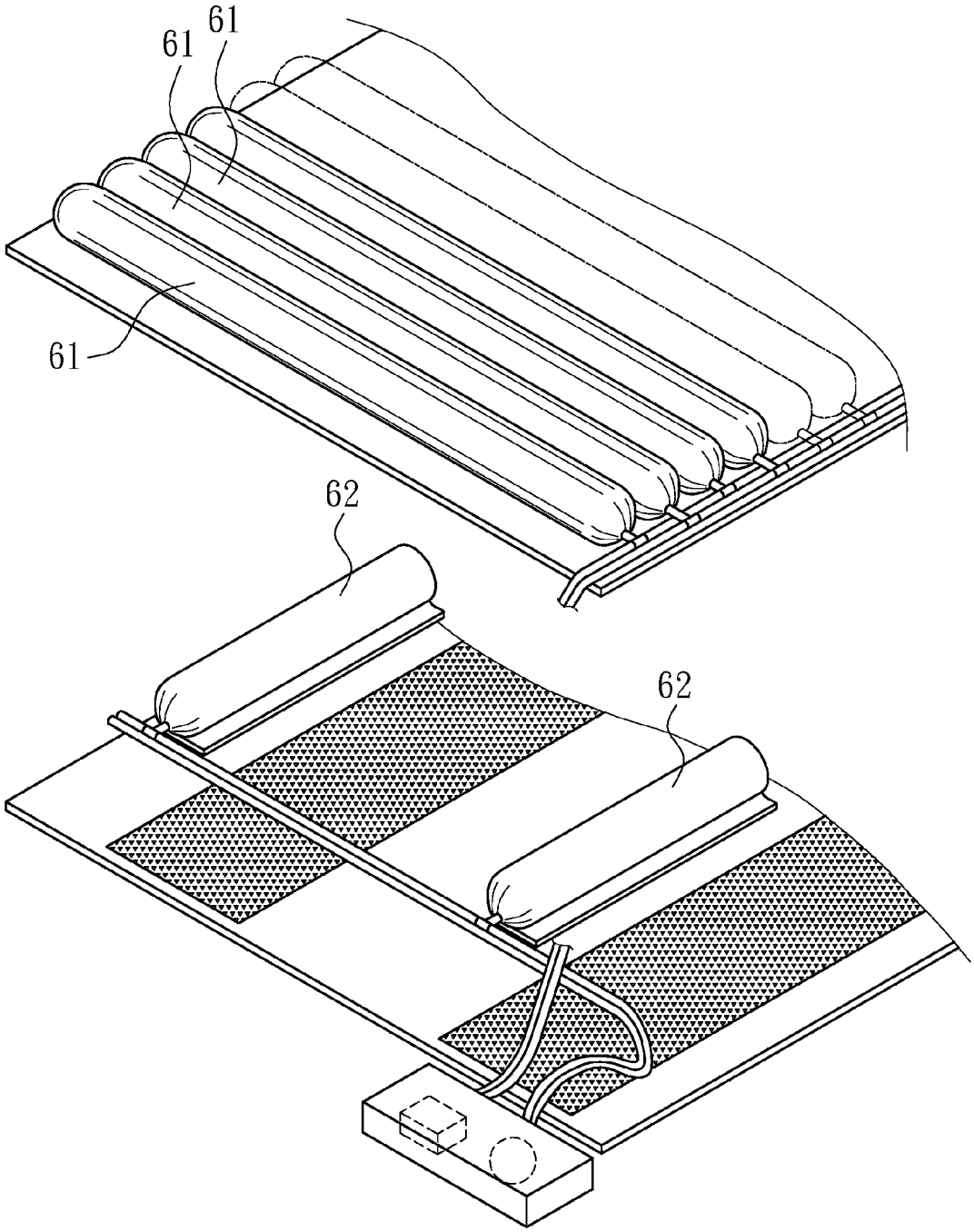
FIG. 8 PRIOR ART
FIG. 8 is a structural view of another conventional airbed with the function of helping turn the patient thereon.

FIG. 6 shows a third embodiment of the invention. This embodiment differs from the previous two embodiments in that the pad bodies 11 of the air pad units are connected into a pad structure by a connector 41 with a W-shaped cross section. The outer layer of the connector 41 is made of double-layer nonwoven fabric, with sports foam enclosed therein. The connector 41 is thus flexible. The disclosed pad can thus adjust its angle according to the elevation of a bed or the curvature of a reclined chair. In this case, the invention can be generally used in usual patient beds, reclined chairs or beach chairs. Moreover, the pad structure using the connector 41 to connect the air pad units has the advantage of being easy to roll for storage. Besides, in this embodiment the air opening 16 of each pad body 11 is integrated on one side of one of the pad body 11. This enables neat and convenient external pipe connections of the invention.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An air tool with a modularized air pad comprising a plurality of air pad units, each of which includes:

one pad body having a top surface and a bottom surface, with an accommodating recess formed on the top surface thereof and an air opening formed at a predetermined position on the outer side thereof, wherein the pad bodies of the air pad units are connected by a connector with a cross section to form a pad structure, with the connector being flexible, the cross section of the connector has a W shape and an outer layer thereof is made of a double-layer nonwoven fabric with sports foam enclosed therein;

two air bags disposed at the bottom of the accommodating recess, each of the air bags having two air chambers and connected with an air pipe, respectively, and the air pipes thereof being connected to the air opening of the pad body through the interior of the pad body; and one buffer pad disposed in the corresponding accommodating recess and resting on the air bags, wherein when the air bags are selectively inflated via the air opening, the buffer pad is pushed to undergo an upward swing.

2. The air tool with a modularized air pad of claim 1, wherein the interior of the pad body has an intermediate layer and the air pipes of the air chambers are connected to the air opening via the intermediate layer.

3. The air tool with a modularized air pad of claim 2, wherein the two air bags have a flat bag shape and are stacked vertically at the bottom of the accommodating recess, with the middle section of the stacked air bags being connected to the intermediate layer.

4. The air tool with a modularized air pad of claim 2, wherein the two air bags are disposed side by side at the bottom of the accommodating recess, with the farther left and right sides thereof connected to the intermediate layer and the air chambers of each of the air bags being stacked vertically.

5. The air tool with a modularized air pad of claim 2, wherein the air bags of at least one air pad unit are stacked vertically at the bottom of the accommodating recess; the middle section of the stacked air bags is connected to the intermediate layer; and the two air bags of at least one air pad unit are disposed side by side at the bottom of the accommodating recess, with the farther left and right sides thereof connected to the intermediate layer and the air chambers of each of the air bags being stacked vertically.

6. The air tool with a modularized air pad of claim 1, wherein the pad body and the buffer pad are made of a foam material.

7. The air tool with a modularized air pad of claim 1, wherein an outside pump inflates or deflates the air chambers of the two air bags via the corresponding air opening on the pad body.

8. The air tool with a modularized air pad of claim 7, wherein the air openings of the pad units are integrated on one side of one of the pad bodies.

* * * * *